US009578926B2

(12) United States Patent
Alt et al.

(10) Patent No.: US 9,578,926 B2
(45) Date of Patent: Feb. 28, 2017

(54) DEVICE FOR AUTOMATICALLY TIGHTENING AND LOOSENING LACES

(71) Applicants: Jepthah Alt, Washington, UT (US); Jesse Kimball, Washington, UT (US)

(72) Inventors: Jepthah Alt, Washington, UT (US); Jesse Kimball, Washington, UT (US)

(73) Assignee: VIBRALABS INCORPORATED, Washington, UT (US)

( * ) Notice: Subject to any disclaimer, the term of this patent is extended or adjusted under 35 U.S.C. 154(b) by 0 days.

(21) Appl. No.: 14/718,330

(22) Filed: May 21, 2015

(65) Prior Publication Data

US 2015/0250268 A1 Sep. 10, 2015

Related U.S. Application Data

(63) Continuation-in-part of application No. 14/107,925, filed on Dec. 16, 2013, now Pat. No. 9,204,690.

(60) Provisional application No. 62/002,011, filed on May 22, 2014, provisional application No. 61/737,982, filed on Dec. 17, 2012.

(51) Int. Cl.

| | |
|---|---|
| ***A43C 11/20*** | (2006.01) |
| ***A43C 11/24*** | (2006.01) |
| ***A43C 11/16*** | (2006.01) |

(52) U.S. Cl.

CPC ..... *A43C 11/20* (2013.01); *A43C 11/165* (2013.01); *A43C 11/24* (2013.01); *Y10T 24/2183* (2015.01)

(58) Field of Classification Search

CPC ..... A43C 11/165; A43C 11/20; A43C 11/24; A43B 3/0005; Y10T 24/2183; Y10T 24/37; Y10T 24/3703; Y10T 24/3713; Y10T 24/3724

USPC ..... 242/388.8, 394

See application file for complete search history.

(56) References Cited

U.S. PATENT DOCUMENTS

| | | | | |
|---|---|---|---|---|
| 3,430,303 | A | 3/1969 | Wakefield et al. | |
| 4,724,626 | A | 2/1988 | Baggio | |
| 4,741,115 | A | 5/1988 | Pozzobon | |
| 4,787,124 | A | 11/1988 | Pozzobon et al. | |
| 5,568,970 | A * | 10/1996 | Prineppi | A47G 33/0809 254/390 |
| 6,289,558 | B1 | 9/2001 | Hammerslag | |
| 6,691,433 | B2 * | 2/2004 | Liu | A43B 3/0005 24/68 SK |
| 7,082,701 | B2 | 8/2006 | Dalgaard et al. | |
| 7,549,201 | B2 | 6/2009 | Kraft et al. | |
| 7,591,050 | B2 | 9/2009 | Hamerslag | |

(Continued)

OTHER PUBLICATIONS

U.S. Appl. No. 14/107,925, Office Action, dated Apr. 30, 2015.

U.S. Appl. No. 14/107,925, Notice of Allowance, dated Oct. 27, 2015.

*Primary Examiner* — Abigail Morrell

(74) *Attorney, Agent, or Firm* — Risso & Associates

(57) ABSTRACT

Described is a tightening device for automatically tightening a lace. The tightening device includes a housing with a power source and a pair of motors. A pair of planetary gear boxes are connected with the motors. A pair of spools are connected with the gear boxes. Laces are wound around the spools such that activation of the motors causes rotation of the spools. The housing can be attached with or otherwise incorporated into the tongue of a shoe, such that the laces are operable as shoe laces. Thus, when a user activates the motors, the laces are wound around the spools to automatically tighten the shoe laces.

3 Claims, 17 Drawing Sheets

(56) References Cited

U.S. PATENT DOCUMENTS

| | | | | |
|---|---|---|---|---|
| 7,752,774 | B2 * | 7/2010 | Ussher ..... | A43B 3/0005<br>36/100 |
| 8,046,937 | B2 | 11/2011 | Beers et al. | |
| 8,522,456 | B2 | 9/2013 | Beers et al. | |
| 8,769,844 | B2 | 7/2014 | Beers et al. | |

* cited by examiner

DEVICE FOR AUTOMATICALLY TIGHTENING AND LOOSENING LACES

CROSS-REFERENCE TO RELATED APPLICATIONS

This is a Continuation-in-Part application of U.S. application Ser. No. 14/107,925, filed on Dec. 16, 2013, and entitled, "Device for Automatically Tightening and Loosening Shoe Laces," which is a non-provisional application of U.S. Provisional Application No. 61/737,982, filed on Dec. 17, 2012, and entitled, "Power Laces."

This is ALSO a non-provisional application of U.S. Provisional Application No. 62/002,011, filed on May 22, 2014, and entitled, "Device for Automatically Tightening and Loosening Laces."

BACKGROUND OF THE INVENTION (1) Field of Invention

The present invention relates to automated shoe laces and, more particularly, to a device for automatically tightening and loosening laces.

(2) Description of Related Art

Tying shoe laces, while seemingly simple, can in many cases be near impossible for some people. For example, learning how to tie shoe laces has been a rite of passage for small children who often struggle to manipulate the laces. Similarly, disabled and elderly individuals who lose digit dexterity often have problems manipulating the thin laces.

Thus, a continuing need exists for a device for automatically tightening and loosening laces, such as shoe laces.

SUMMARY OF INVENTION

The present invention is directed to a tightening device for automatically tightening a lace. The tightening device includes a housing and a first motor attached with the housing. A power source is operably connected with the first motor. A first spool is connected with the first motor such that activation of the first motor causes rotation of the first spool, whereby a user can activate the first motor to cause the first spool to wind a lace around the first spool.

In another aspect, the tightening device further comprises a second motor attached with the housing and a second spool connected with the second motor.

In yet another aspect, the tightening device further comprises two gear boxes, such that each gear box is connected with and between a motor and spool. Further, each gear box is adapted to increase torque applied to the spool.

Additionally, each gear box includes a planetary gear system to increase the torque applied to the spool.

In another aspect, the tightening device includes one or more laces attached with the spools, such that activation of the motors causes the one or more laces to wind around the spools.

In yet another aspect, the motors are locking motors that rotate in a single direction and lock when deactivated.

In another aspect, the tightening device includes a release mechanism connected with the housing. The release mechanism is adapted to allow a user to selectively disengage the spools from the motors and, thereby, unwind the laces.

In yet another aspect, the motors and gear box are slideably held in the housing. A bias mechanism is included to force the motors and gear boxes into an engaging relationship with the spools.

Additionally, the release mechanism includes at least one release tab that is attached with the motors and that projects from the housing. The release tab is adapted to allow a user to slide the motors and gear boxes out of the engaging relationship with the spools and, thereby, disengage the spools and unwind the laces.

In another aspect, the housing is incorporated into a tongue of a shoe having lace holes (with the laces threaded through the lace holes). Upon activation of the motors, the spools wind the one or more laces around the spools and, in doing so, tighten shoe laces of the shoe.

In yet another aspect, the housing is formed in the shape of a figurine.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
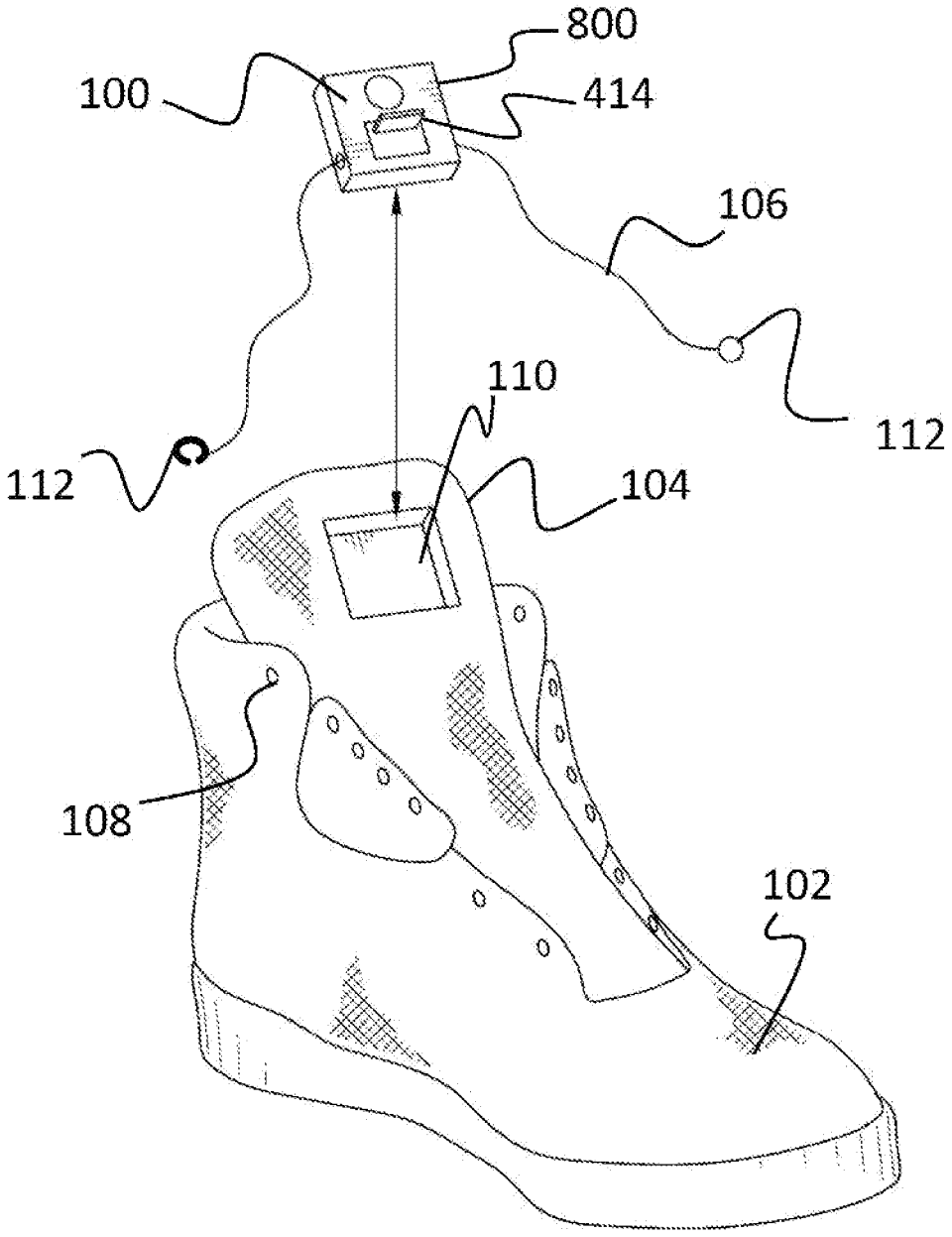
FIG. 1 is an illustration of a tightening device for tightening and loosening laces according to the principles of the present invention, depicting the device as being applied to a shoe.

The present invention relates to automated shoe laces and, more particularly, to a tightening device for automatically tightening and loosening laces (e.g., shoe laces). The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to automated shoe laces and, more particularly, to a tightening device for automatically tightening and loosening shoe laces. It should be understood that although the invention is described with respect to shoe laces, the invention is not intended to be limited thereto as it can be applied to any device or item where it may be desirable to tighten or cinch a filament or lace. Thus, the use of a shoe is provided as a non-limiting example of a suitable application for the device described herein. Further, it should be understood that the term "lace" is intended to mean any thread-like item that can be wound around a spool, such as a filament, thread, rope, yarn, shoe lace, etc. Thus, generally speaking, the invention is directed to a device for tightening and loosening laces.

An example of such a device is illustrated in FIG. 1. As shown in FIG. 1, the tightening device 100 can be incorporated into a shoe 102, such as the tongue 104 of the shoe 102. In this example, the tightening device 100 includes laces 106 that can be threaded through the lace holes 108 of the shoe 102. The tightening device 100 can be affixed with the shoe 102 using any suitable mechanism or technique. As a non-limiting example, the tightening device 100 can be fastened to the shoe 102 with a common clip. As another non-limiting example, the tightening device 100 can be adhered to the shoe 102 with a fastener, such as a hook and loop fastener (e.g., Velcro™). As yet another non-limiting example and as illustrated in FIG. 1, the tongue 104 of the shoe 102 can include a cavity 110 that is formed to matingly receive the tightening device 100. Thus, in this aspect, the tightening device 100 can be press fit into the cavity 110 and remain held within the cavity 110.

It should also be noted that the laces 106 can be continuous or, in another aspect, separated. In yet another aspect, the laces 106 can be separated but attachable. For example and as illustrated in FIG. 1, the laces 106 include end connectors 112 that allow the ends of the laces 106 to be connected with one another or some other item. The end connectors 112 are any suitable mechanism or device that allows the laces 106 to be connected upon themselves or to another item, non-limiting examples of which include a hook and loop fastener, a clasp mechanism, and a compression clasp.

Figure 2:
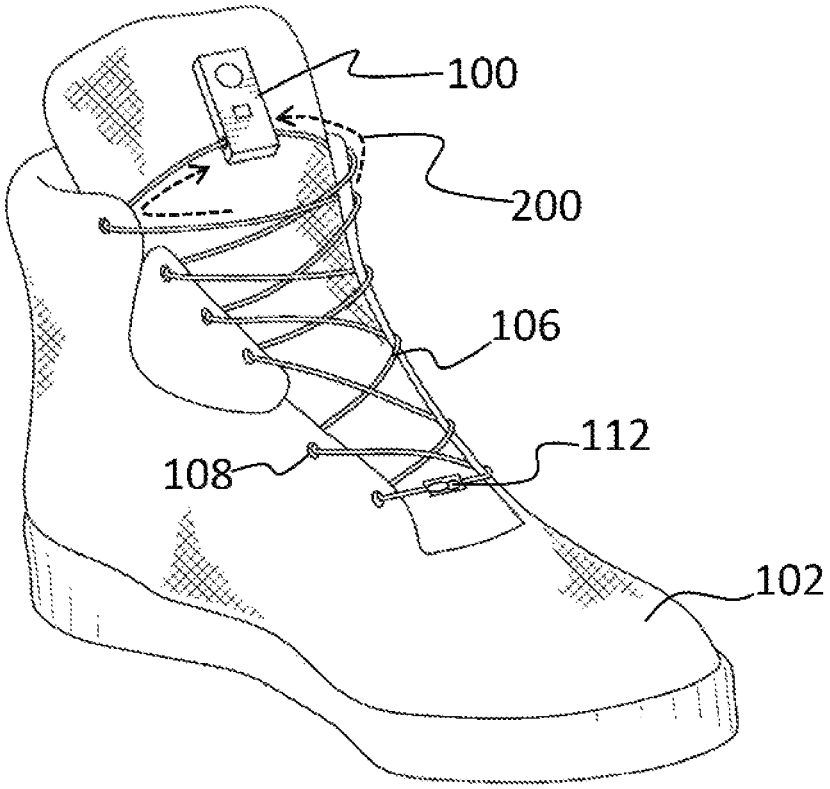
FIG. 2 is an illustration of the device as attached with a shoe according to the principles of the present invention, depicting the laces in a loosened state.
Figure 3:
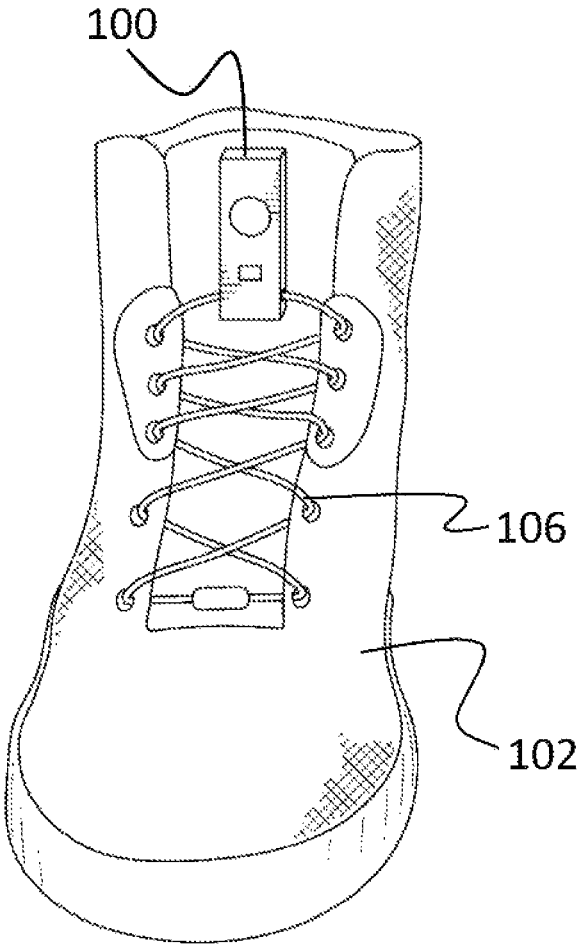
FIG. 3 is an illustration of the device as attached with a shoe according to the principles of the present invention, depicting the laces in a tightened state.

Thus, in one aspect and as a shown in FIG. 2, after the laces 106 are threaded through the lace holes 108 of the shoe 102, the end connectors 112 can be used to connect the laces 106 with one another to make a continuous lace 106. After being attached with the shoe 102, the tightening device 100 can be activated to draw 200 the laces 106 into the tightening device 100 and, thereby, tighten the laces 106. For further understanding. FIG. 3 illustrates the tightening device 100 and shoe 102 after the laces 106 have been tightened (i.e., drawn into the tightening device 100). In other words, FIG. 2 illustrates a shoe 102 with laces 106 that have not yet been tightened, while FIG. 3 illustrates the same shoe 102 with tightened laces 106.

Thus, the tightening device 100 is any suitable mechanism or device that is operable for drawing one or more laces 106 into the device, non-limiting examples of which are depicted in FIGS. 1 through 16.

Figure 4:
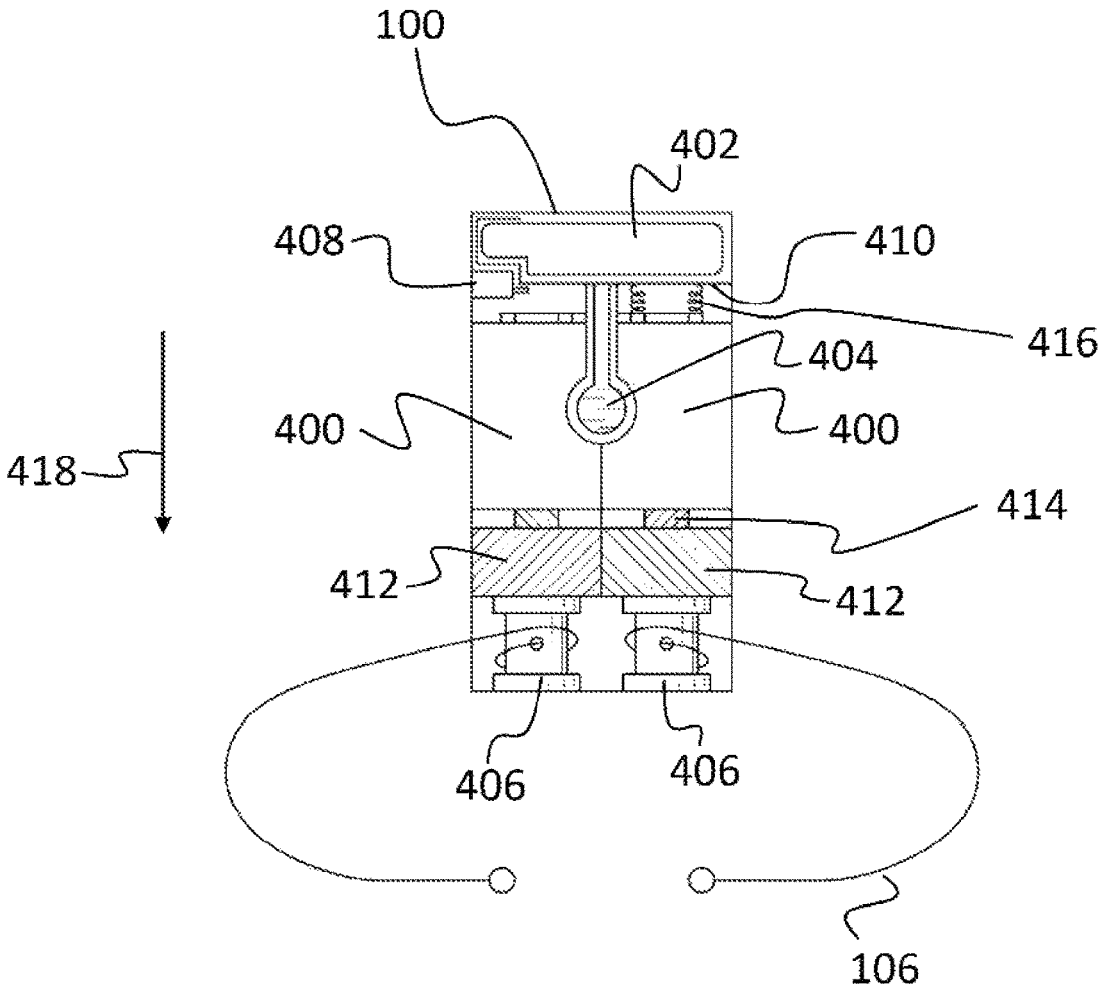
FIG. 4 is a front, interior-view illustration of the device according to the principles of the present invention, depicting an aspect that includes dual motors.

For example and as shown in the interior-view illustration of FIG. 4, the tightening device 100 includes one or more motors 400, a power source 402, a control switch 404, and one or more spools 406 for winding the laces 106. Although the tightening device 100 can be implemented with a single motor 400 and spool 406, desirably, the device 100 includes a pair of motors 400, each with its own spool 406. An advantage to using a pair of motors 400 and spools 406 is that the device can quickly wind the laces 106 while reducing the likelihood of the laces tangling 106 (if, for example, a single spool 406 was used).

Thus, in operation, a user can use the control switch 404 to activate the motors 400 (which are powered by the power source 402). Once activated, the motors 400 rotate the spools 406 to wind the laces 106 around the spools 406 and effectively draw the laces 106 into the tightening device 100.

It should be understood that the power source 402 is any suitable mechanism or device that is operable for powering the motors 400, non-limiting examples of which include replaceable batteries, a rechargeable battery, a mini power generator (powered by walking), and a solar panel. In one aspect, the power source 402 is a replaceable battery. However, desirably, the power source 402 is a rechargeable battery. As a non-limiting example, the power source 402 is a 70 mAh, 3.7 Volt, lithium polymer (LiPo) battery. The power source 402 can be recharged using any suitable recharging device, technique and/or port. As a non-limiting example, a charge port 408 can be included. Also, a switch and/or circuit board is optionally included. As a non-limiting example, a flexible printed circuit board (PCB) 410 is included with the device 100. For example, the charge port 408 is connectable with a micro-USB (or any other connection) and is electrically connected with the PCB 410, which in turn is connected with the control switch 404 and motors 400. Thus, in one aspect, a user can simply charge the LiPo batteries via the charge port 408 (using a micro-USB charger) and control the motors 400 via the control switch 404.

As noted above, the power source 402 can optionally be charged by walking. A non-limiting example of such a charging system was described in U.S. Pat. No. 6,255,799, entitled, "Rechargeable Shoe," which is hereby incorporated by reference as though fully set forth herein. Thus, the present invention can include any rechargeable walking system. As another non-limiting example, a mini solar panel can be affixed on the tongue of the shoe, with the solar panel being electrically connected with the PCB 410 and/or power source 402 to recharge the power source 402. Thus and as can be appreciated by those skilled in the art, the power source 402 can be recharged using any recharging technique that is known to those skilled in the art.

The motors 400 are any motors that are operable for winding the laces 106 around the spools 406. Desirably, the motors 400 are locking motors that only spin a single direction and lock when deactivated. An advantage to this is that it prevents the motors 400 from being forcibly rotated in a reverse direction that causes the laces 106 to inadvertently unwind from the spools 406. One non-limiting example of such a motor is a 10 millimeter (mm), 100 rotations per minute (RPM) motor.

In one aspect, the motors 400 (and their shafts) are directly connected to the spools 406. However, desirably and in one non-limiting aspect, a set of gear boxes 412 are included (one corresponding to each motor 400 and spool 406). Each gear box 412 includes a gear system that is operable for increasing the torque that is applied to the corresponding spool 406. As a non-limiting example and as further described below, each gear box 412 includes a planetary gear system to increase the torque applied to the spools 406.

At some point after winding the laces 106 around the spools 406, it may be desirable to loosen the laces 106. For example, at some point the wearer of the shoe (depicted as element 102 in FIG. 3) would like to loosen the laces 106 to remove the shoe 102. Thus, the tightening device 100 is formed to allow a user to selectively loosen the laces 106. The laces 106 may be loosened using any suitable mechanism, technique or device that allows a user to selectively loosen the laces 106 after being wound around the spools 406. As one non-limiting example, a reverse switch 1200 (illustrated in FIG. 12) can be included to cause the motors 400 to reverse rotation and thereby unwind the laces 106 from the spools 406. This aspect is described in further detail below.

Figure 5:
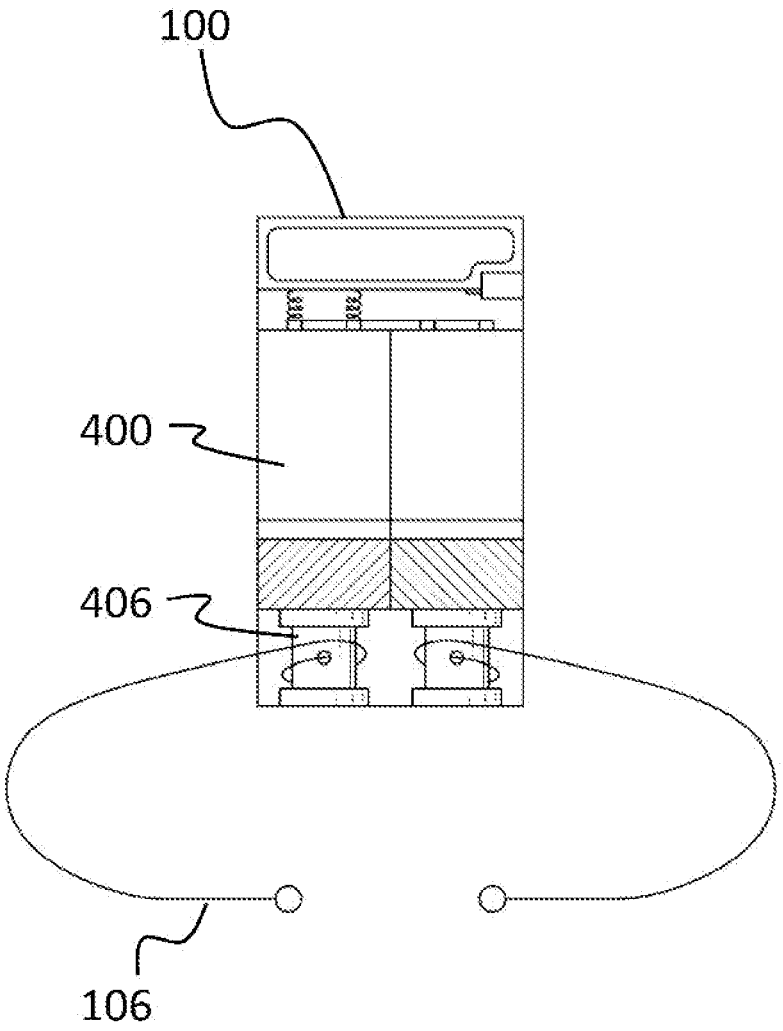
FIG. 5 is a rear, interior-view illustration of the device depicted in FIG. 4.

In yet another aspect, a mechanical release mechanism can be included to allow the user to mechanically loosen the laces 106. The mechanical release mechanism is any suitable mechanism or device that allows a user to selectively and mechanically loosen the laces 106 from the spools 406. As a non-limiting example, release tabs 414 are included that allow a user to pull the motor 400 and/or gear box 412 away from the spool 406. At rest, springs 416 or some other bias mechanism forces the motors 400 and/or gear boxes 412 in a direction 418 such that they engage with the spools 406. However, using the release tabs 414, a user can manually pull the motors 400 and/or gear boxes 412 out of engagement of the spools 406 and, in doing so, allow the spools 406 to spin freely and unwind the laces 106. As a non-limiting example, the device 100 includes a ring For further understating FIG. 5 is a rear, interior-view illustration of the tightening device 100. As shown, the device 100 includes one or more motors 400 that are operatively connected with spools 406 for winding laces 106 around the spools 106.

Figure 6:
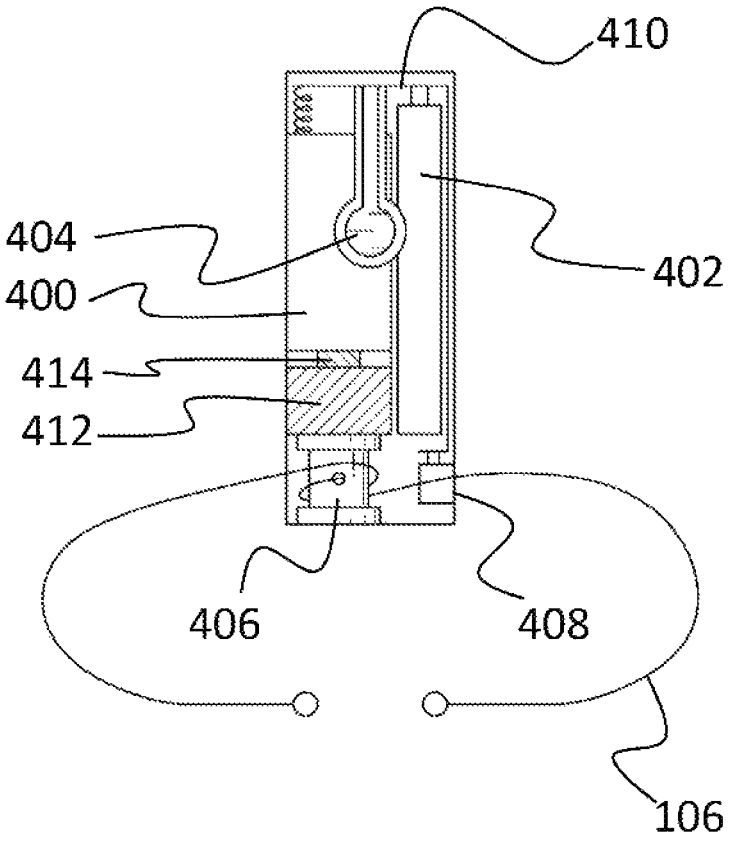
FIG. 6 is a front, interior-view illustration of the device according to the principles of the present invention, depicting an aspect that includes a single motor.
Figure 7:
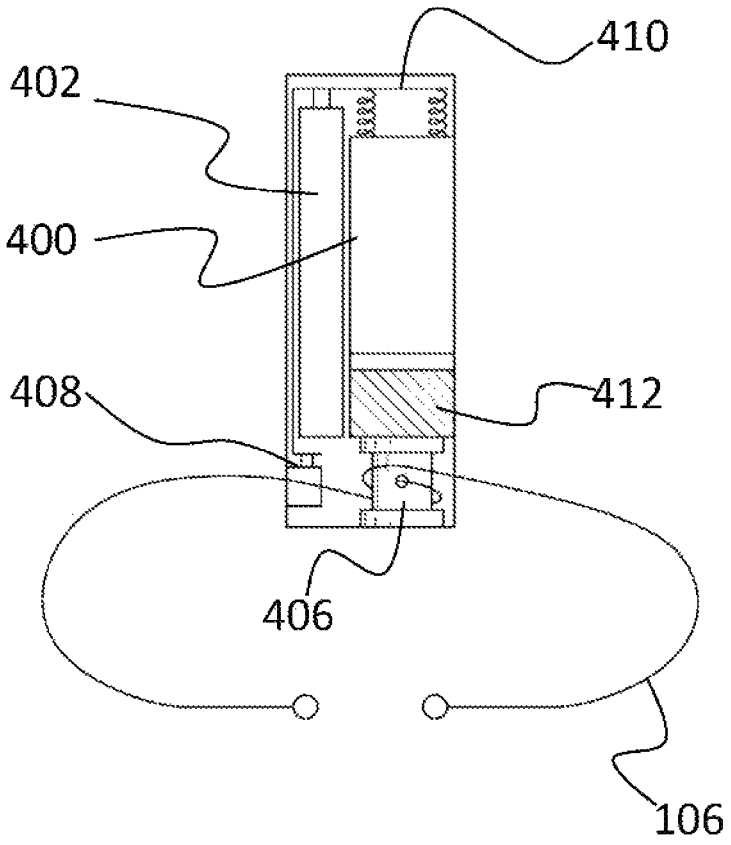
FIG. 7 is a rear, interior-view illustration of the device depicted in FIG. 6.

As noted above, the tightening device 100 can be formed to include any desired number of motors 400. For example, FIGS. 6 and 7 illustrate an example in which a single motor 400 is used. Specifically, FIG. 6 is a front side, interior-view illustration of the tightening device 100, while FIG. 7 is a rear side, interior view of the device 100. To be contrasted with the example above (with respect to dual motors 400), the device 100 depicted in FIGS. 6 and 7 includes a single motor 100 connected with a gear box 412 and a spool 406 for winding the laces 106. The device 100 also includes the power source 402 connected with the PCB 410 that can be recharged via the charging port 408. A control switch 404 is communicatively connected (e.g., electrically) with the PCB 410 to allow a user to selectively activate the motor 400 and wind the laces 106 around the spool 406.

As was the case above, any suitable release mechanism can be employed to allow a user to release (e.g., disengage) the spools 406 and, thereby, unwind the laces 106. For example, release tabs 414 are included that allow the user to slide the motor 400 and/or gear box 412 out of engagement with the spool 406 which allows the spool 406 to unwind.

Figure 8A:
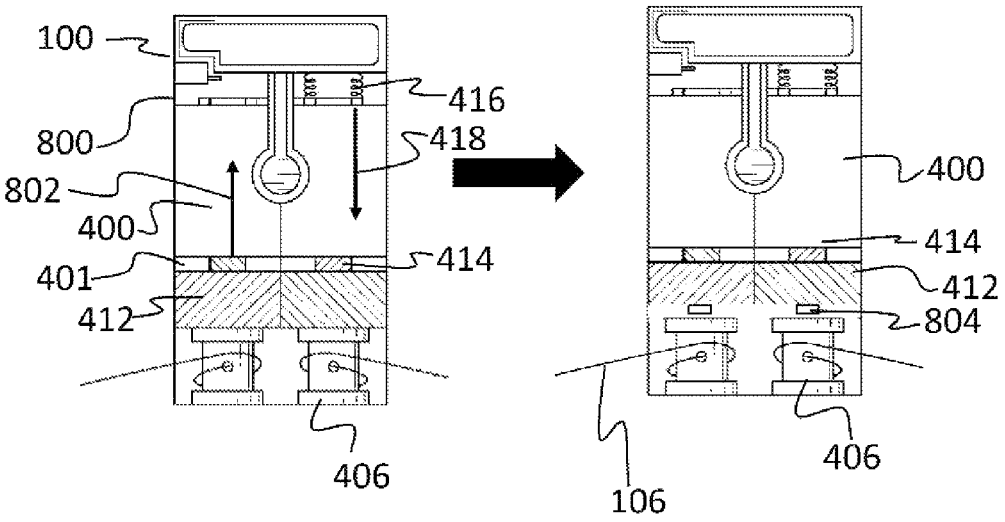
FIG. 8A is an illustration of a release mechanism according to the principles of the present invention.
Figure 8B:
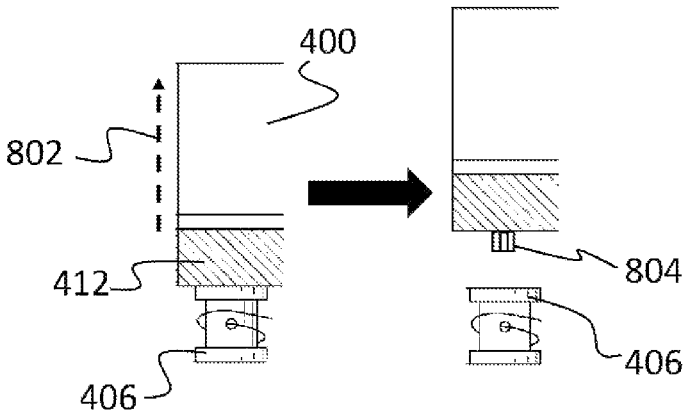
FIG. 8B is an illustration of a release mechanism according to the principles of the present invention.
Figure 9:
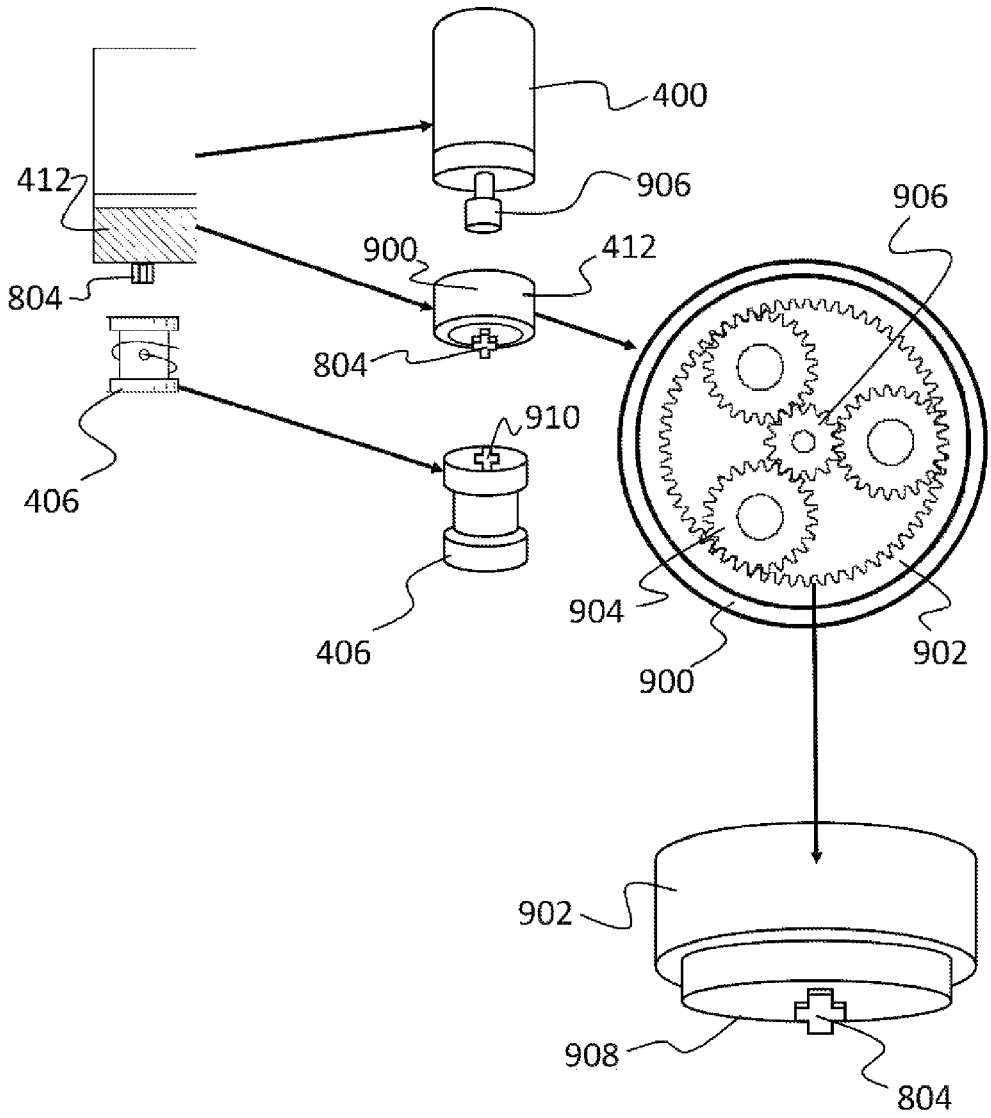
FIG. 9 is an illustration of a gear box according to the principles of the present invention, depicting a combination of side, perspective, and cross-sectional views.

Further illustrations of a non-limiting example of such a release mechanism are provided in FIGS. 8A through 9. As shown in FIG. 8A, the motors 400 and/or gear boxes 412 are slidably held within the housing 800 of the device 100. Expansive springs 416 or any other bias mechanism can be used to force the motors 400 and/or gear boxes 412 towards 418 and into an engaging relationship with the spools 406. The release tabs 414 are fixedly attached with the motors 400 and/or gear boxes 412 and project out of the housing 800. As a non-limiting example, the device 100 includes a ring 401 that is affixed (via glues, screws, etc.) with and between the motors 400 and gear boxes 412. The release tabs 414 project from the ring 401 to outside the device 100 for use by a user.

Thus, in one aspect and as illustrated in FIG. 1, the release tab(s) 414 projects from the housing 800 to allow it to be easily grasped and/or manipulated by a user. Referring again to FIG. 8A, by sliding the release tabs 414 away 802 from the spools 406, the motors 400 and/or gear boxes 412 are lifted and slid out of engagement with the spools 406. For example, the gear boxes 412 each include a spool connector 804 that matingly engages with the spools 406 and is operably for locking into engagement with and rotating the spools 406 when the motors 400 are activated. Thus, when the release tabs 414 are used to slideably move the motors 400 and/or gear boxes 412 away 802 from the spools 406, the spool connectors 804 are pulled from the spools 406, which allow the spools to then freely spin and unwind the lances 106. This concept is further illustrated in FIG. 8B, which shows a single motor 400 and/or single gear box 412 being lifted away 804 from the spool 406 to draw the spool connector 804 out of engagement with the spool 406.

As noted above, the gear box 412 is any suitable gear system that can be implemented to increase/decrease torque or speed as may be desired. As a non-limiting example and as illustrated in FIG. 9, the gear box 412 is a planetary gear set. In this non-limiting example, the gear set 412 includes a gear housing 900 that operably contains a ring gear 902 and a plurality of planetary gears 904. Driving the gear set 412 is the sun gear 906, which is connected with the motor 400. Thus, activation of the motor 400 causes the gear set 412 and ultimately the ring gear 902 to rotate.

The ring gear 902 is formed as a ring drum that fits within and rotates within the gear housing 900. Attached with an exterior 908 of the ring drum is the spool connector 804 that is formed to matingly engage with a corresponding gear connector 910 formed or attached with the spool 406. The spool connector 804 and gear connector 910 are formed in any suitable shape, size, dimension and manner that allow the two components to matingly (i.e., lockingly) engage with one another. As a non-limiting example and as illustrated, the spool connector 904 is a cross-shaped protrusion, while the gear connector 910 is formed as a cross-shaped receptacle that receives the cross-shaped protrusion. It should be understood that the protrusions and receptacles can easily be reversed or formed in any other shape or size according to the principles of the present application.

Figure 10:
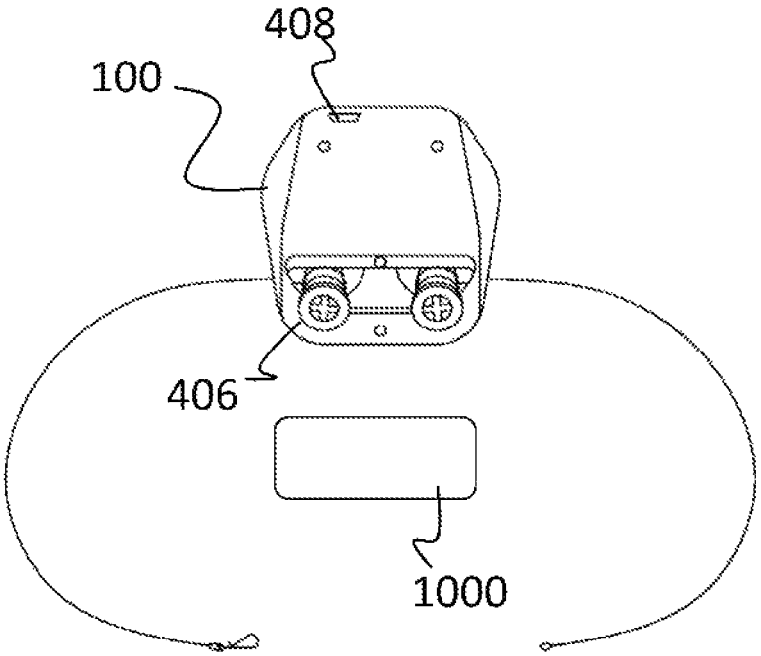
FIG. 10 is an illustration of the device according to the principles of the present invention, depicting a spool cover being removed from the device.
Figure 11:
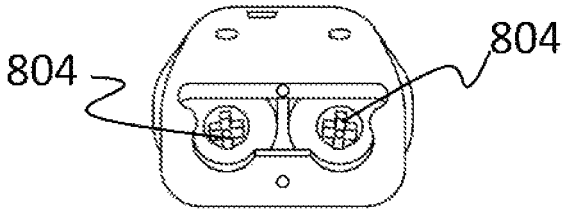
FIG. 11 is an illustration of the device according to the principles of the present invention, depicting the spools being removed from the device to illustrate corresponding motors and spool connectors.

FIG. 10 provides an illustration of another example of the tightening device 100. As shown, a spool cover 1000 can be removed to view the spools 406 inside the device 100. Also as shown, a charge port 408 can be included to charge the power source therein. FIG. 11 provides an illustration in which the spools have been removed from the device 100. Thus, when the spools are removed, the spool connectors 804 are easily seen.

Figure 12:
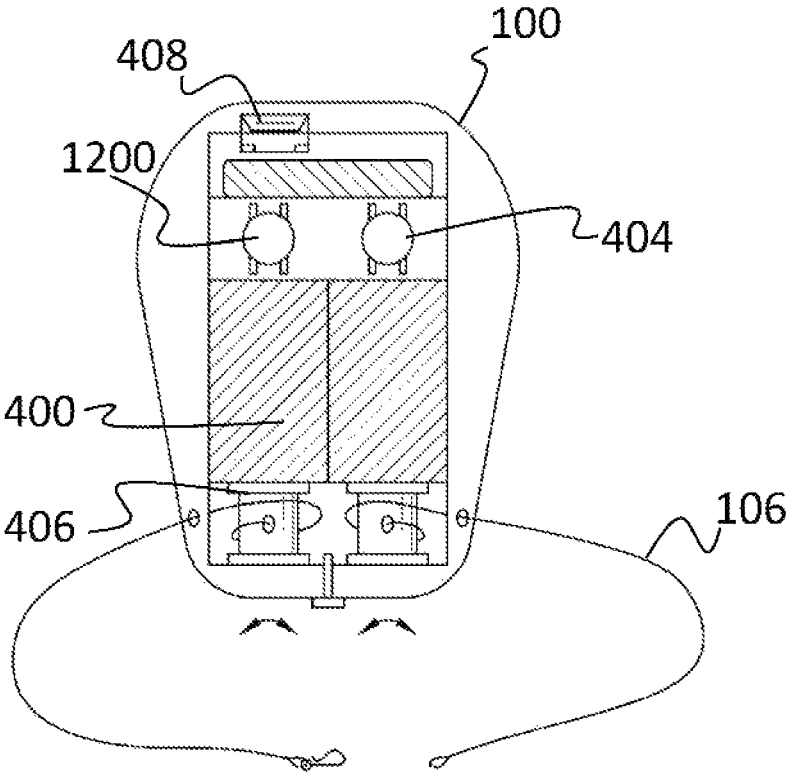
FIG. 12 is an interior-view illustration of the device as depicted in FIGS. 10 and 11.
Figure 13:
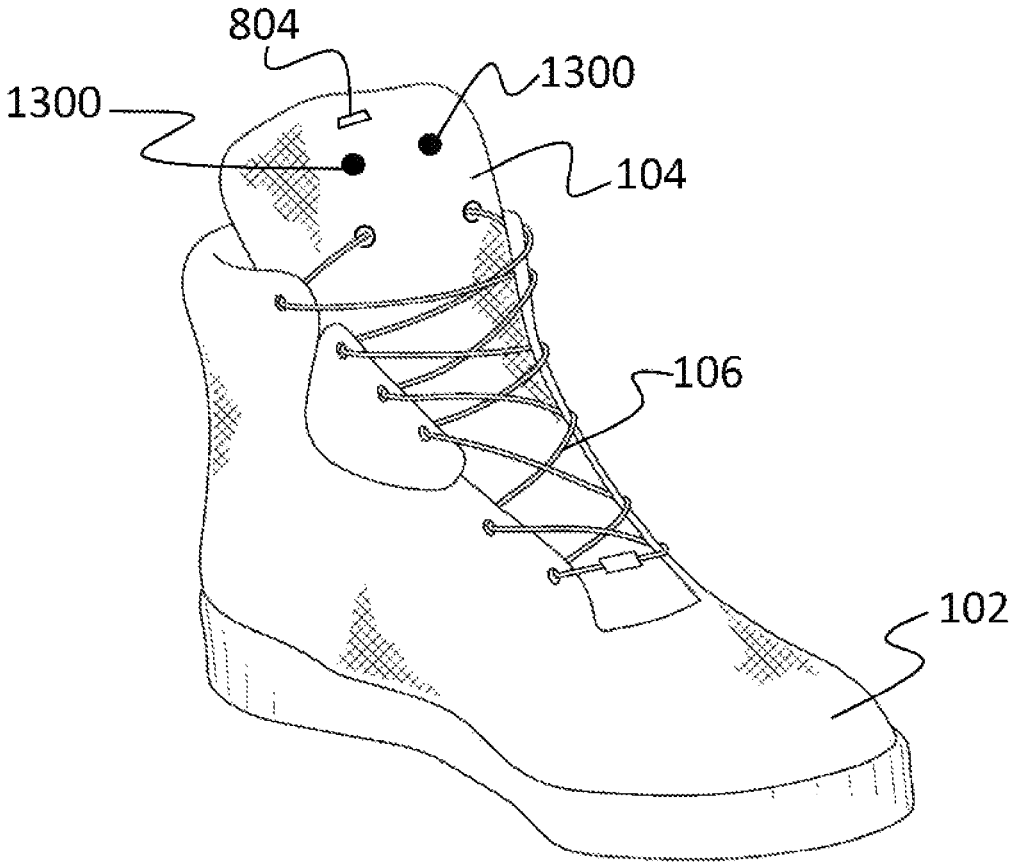
FIG. 13 is an illustration depicting the device being incorporated within a tongue of a shoe.

As noted above, the device 100 can be formed to include a reverse function. FIG. 12 provides an interior-view illustration of an aspect of the device 100 that includes a reverse switch 1200 (which is operably connected with the PCB and/or motors 400). Thus, in this aspect, a first control switch 404 causes the motors 400 to rotate the spools 406 and wind the laces around the spools 406. Alternatively, the reverse switch causes the motors 400 to reverse rotational direction of the spools 406 and, thereby unwind the laces 106. An example of such a device is illustrated in FIG. 13. In this non-limiting example, the device is entirely concealed within the tongue 104 of the shoe 102. Also shown is a charge port 804 that would allow a user to easily charge the power source therein. Buttons 1300 can be attached with the device that project from the tongue 104 or are otherwise operable by pressing in the designated spots on the tongue. The buttons 1300 are connected with the control switch and/or reverse switch as needed to allow for operation of the device and tightening and/or loosening of the laces 106.

Figure 14:
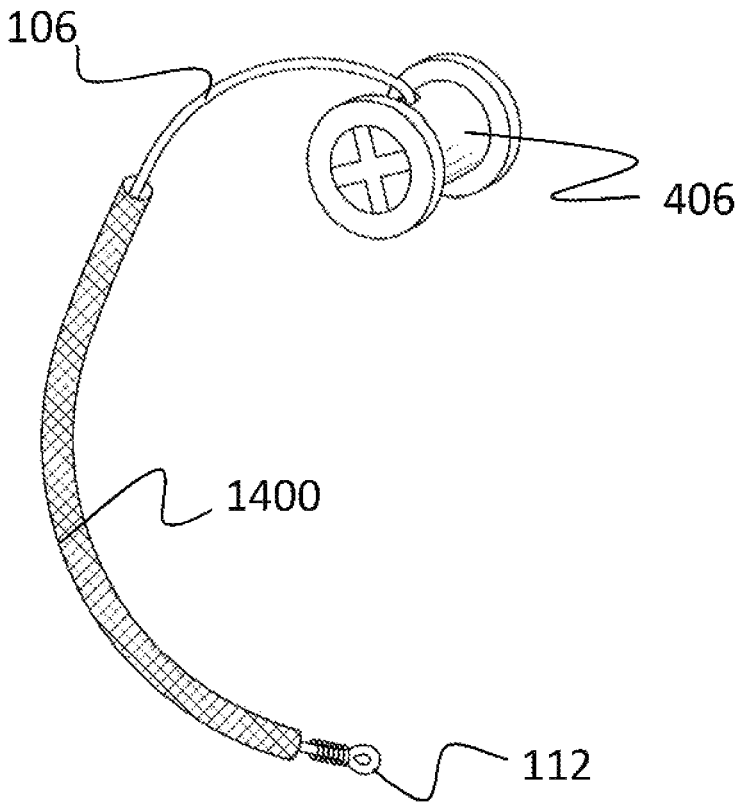
FIG. 14 is an illustration of lace and a spool according to the principles of the present invention.

With respect to the laces 106 and as referenced above and illustrated in FIG. 14, the laces 106 are any thread-like item that can be wound around a spool 406, non-limiting examples of which include a 50 pound fishing test line and a Dyneema Braided line or any braided line having any suitable pound test line (e.g., 10 200 pound test and, more desirably, an 80 to 180 pound test line). Dyneema Braided line is produced by DSM Dyneema LLC, located at 1101 Highway 27 South, Stanley, N.C. 28164, USA. Although not necessary, as another option, a lacing sleeve 1400 can be positioned around the lace 106. The lacing sleeve 1400 increases the ability of the lace to be drawn through the lace holes (depicted as element 108 in FIG. 1) and into the tightening device.

The laces 106 can be a loop that is attached with the spool 406 or, as illustrated, include an end connector 112 that allow the ends of the laces 106 to be connected with one another or some other item.

Figure 15:
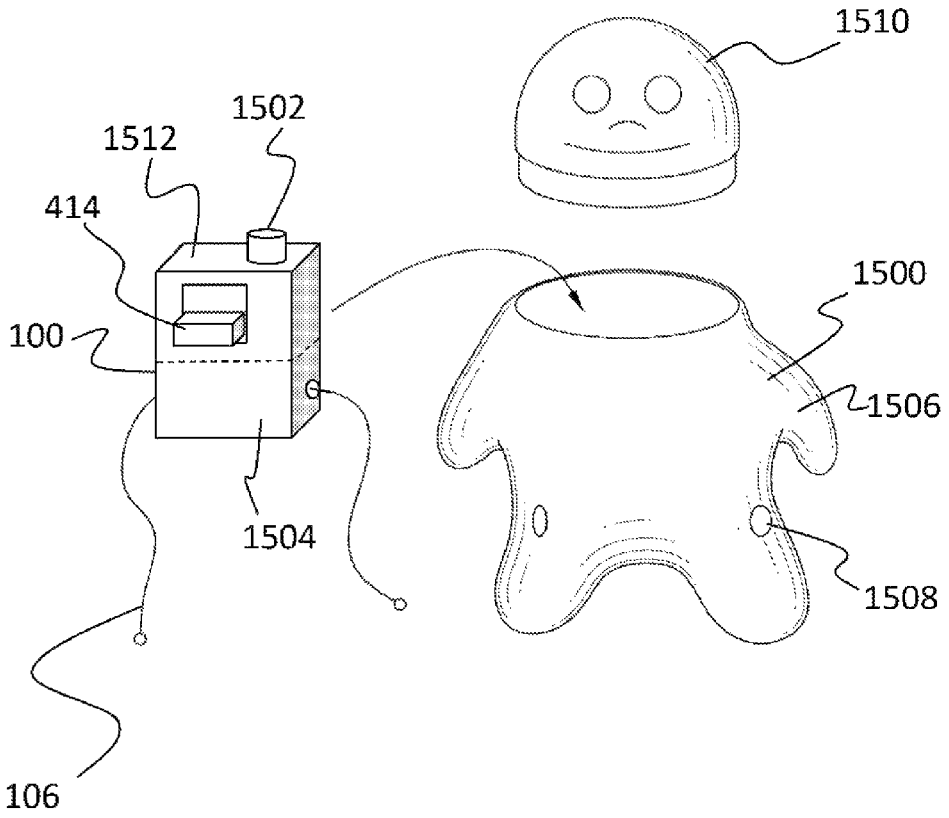
FIG. 15 is an illustration depicting the device being incorporated into a figurine.
Figure 16:
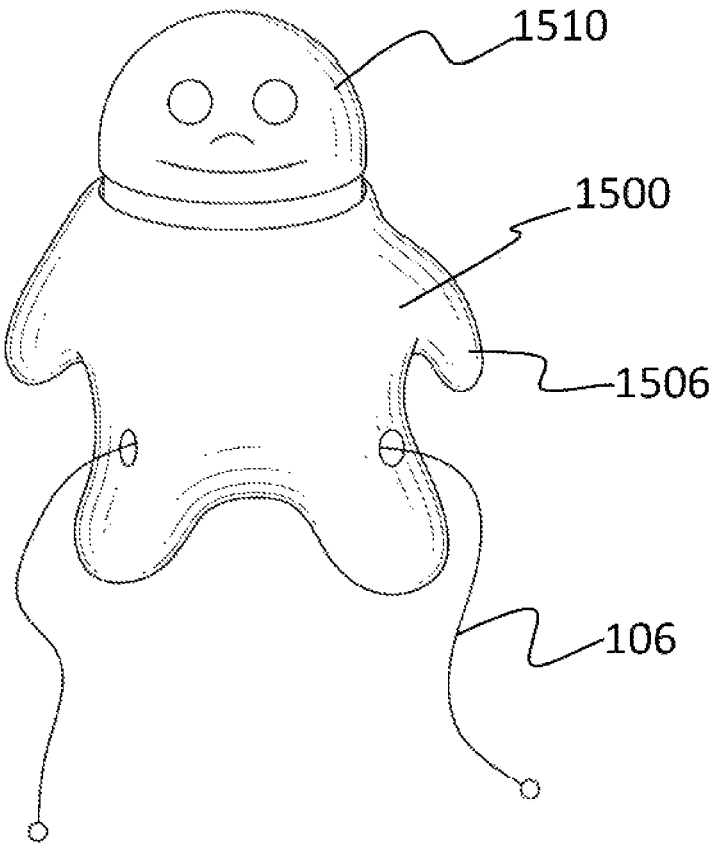
FIG. 16 is an illustration depicting the figurine with the device therein.

Although illustrated as attached with the tongue of a shoe, it should be understood that the device 100 can be incorporated into or utilized with any suitable mechanism or device. As a non-limiting example, FIGS. 15 and 16 illustrate the device as being incorporated into a figurine 1500. In this non-limiting example, a button 1502 is included with the device 100 that is operably connected with the control switch to activate the motors. Thus, depression of the button 1502 activates the motors and causes the motors to wind the laces 106. In this non-limiting example, the release mechanism includes a release tab 414 that projects from the device 100. A bottom portion 1504 of the device 100, for example, can be positioned and affixed (via glue, press fit, etc.) into a body portion 1506 of the figurine 1500. In this aspect, the laces 106 can be thread through the figurine lace holes 1508 formed in the body portion 1506 of the figurine 1500. The head 1510 of the figurine 1500 can then be positioned over a top portion 1512 of the device such that the release tab 414 is fixedly connected with the head 1510 and the head 1510 is then slideably connected with the body portion 1506. The completed configuration for this non-limiting example is depicted in FIG. 16. In operation, one could compress the head 1510 which would depress the button 1502 and cause the laces 106 to be drawn into the device 100. Alternatively, one could pull the head 1510 up and slightly away from the body portion 1506, which would pull the release tab 414 and in turn release the spools from the gear box and allow a user to unwind/untighten the laces 106. In this aspect, for example, instead of being incorporated into the tongue of a shoe, the figurine 1500 can simply be positioned proximate to or clipped to the tongue, with the laces 106 then being wound through the lace holes of the shoe. As can be appreciated, such a separately formed and attached tightening device 100 would allow the tightening device 100 to be utilized with any pre-existing shoe or any other item where it may be desirable to tighten or cinch a lace or laces. It should also be understood that the figurine was provided for illustrative purposes only of one example and that the invention is not intended to be limited thereto as the tightening device can be incorporated into a variety of items, non-limiting examples of which include toy cars, toy planes, toy animals, etc.

It should be noted that the tightening device 100 can be modified to include additional functional features. For example, a sound chip can optionally be included within the tightening device 100 and operably connected with the various buttons, power source, and controls. The sound chip can be programmed with any desired audio message such that upon actuation, the sound chip emits an audio signal. The sound chip is any suitable device (e.g., integrated circuit) that is designed to produce sound. If necessary (depending on the particular sound chip selected), a micro-speaker may be operably connected with the sound chip. The sound chip can be programmed to generate any desired audio signal. As a non-limiting example, when tightening device 100 is activated, the sound chip can generate a sound signal such as "Power Laces Activated." Alternatively, when the tightening device is loosened, the sound chip can be activated to generate a sound signal such as "Power Laces De-Activated."

It should also be noted that although buttons and controls are referenced above, the tightening device 100 is not limited thereto as it can be formed to include a wireless receiver and corresponding circuitry and controllers to allow the tightening device to be controlled remotely using any wireless communication technique. For example, FIG. 17 provides a non-limiting example of a block diagram depicting receiver components of the tightening device (when in a wireless configuration), while FIG. 18 illustrates an example of remote control device 1800 for remotely controlling the tightening device 100.

Figure 17:
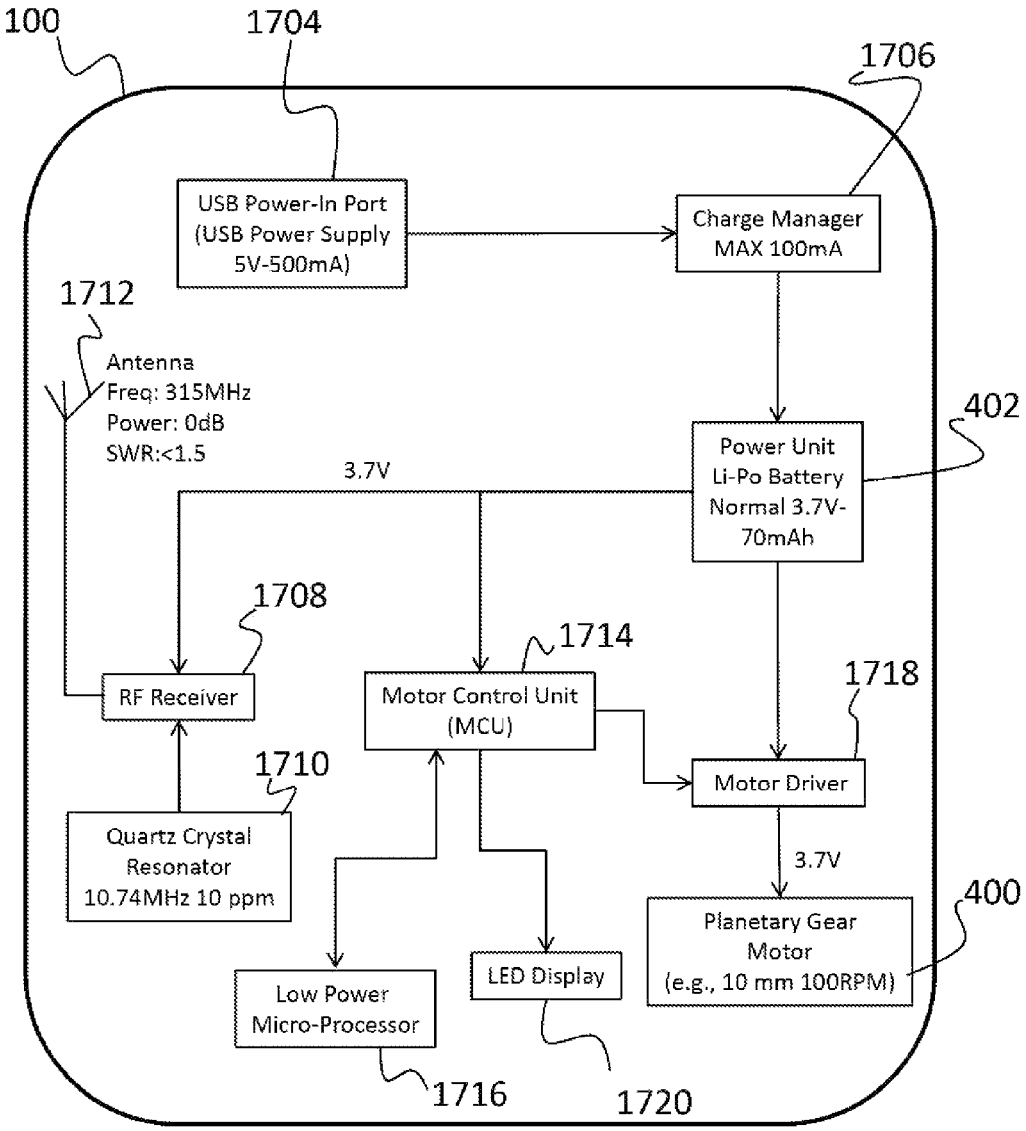
FIG. 17 is a block diagram depicting receiver components of the tightening device.
Figure 18:
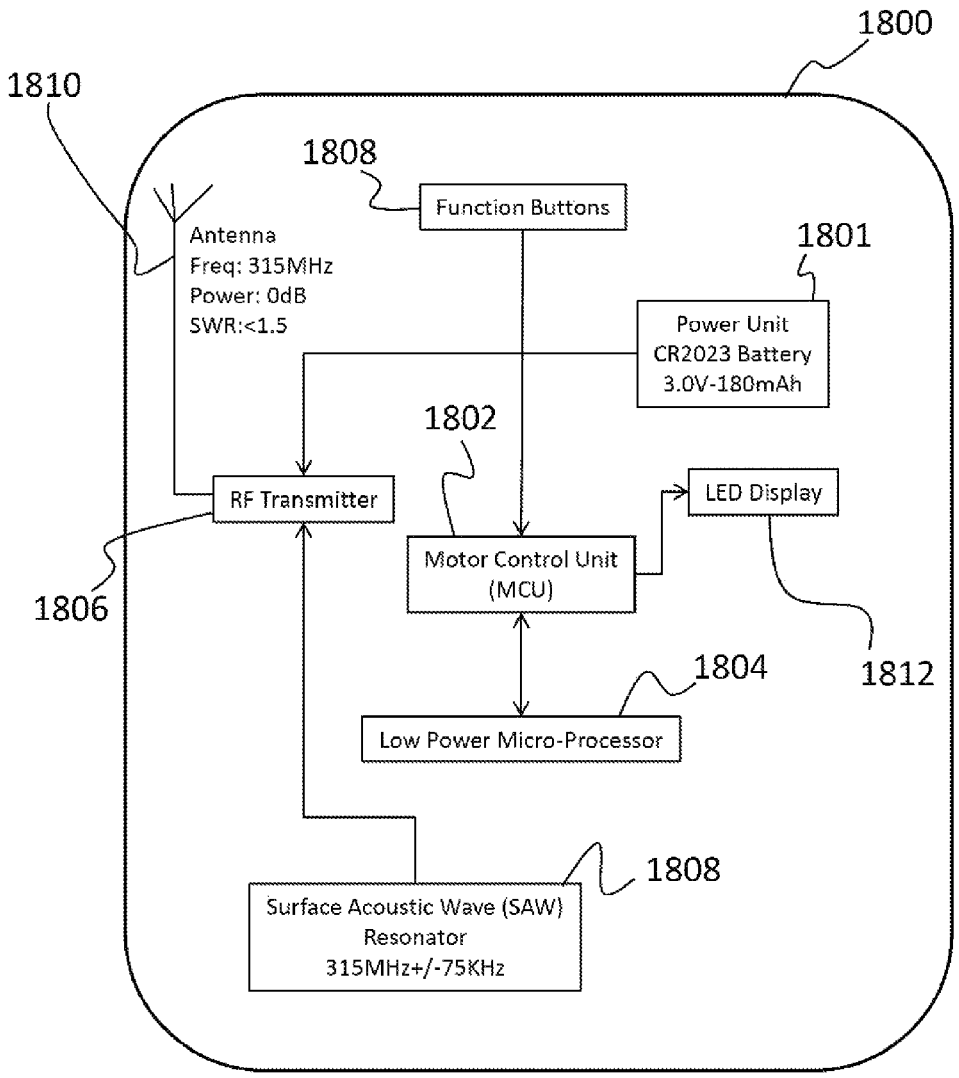
FIG. 18 is a block diagram depicting components of a remote control device according to the principles of the present invention.

In order to operate the tightening device 100 remotely, the tightening device 100 and remote control device 1800 include a variety of individual components housed therein, as depicted in FIGS. 17 and 18, respectively. Specifically and as referenced above, FIG. 17 is a block diagram depicting individual components incorporated into the tightening device 100. As can be appreciated by one skilled in the art, there are many components that can be incorporated into a tightening device to provide the functions listed herein and, as such, the components described and illustrated are but one non-limiting example as the invention is not intended to be limited thereto as the components can be swapped, combined, replaced, and/or modified as need to provide the tightening device 100 with the functionally as described and/or desired.

In one aspect, the tightening device 100 includes a rechargeable power source 402 that is used to power the one or more motors 400 (e.g., planetary gear motors). The other components listed are included to enhance the functionality of the end product or tightening device 100. For example, the rechargeable power source 402 can be provided power using any power connection technique, a non-limiting example of which includes a USB Power-In Port 1704 (i.e., charging port) that is electrically connected with a charge manager 1706 to control the charge that is being provided to the power source 402.

The USB Power-In Port 1704 can accommodate any suitable power-in supply, a non-limiting example of which includes a USB power supply of 5V-500 mA, such as that provided by a computer or other USB charging device. For example, a 110 Volt AC wall charger can be utilized with a 5 Volt output and a 500 mA charge rate. Such a wall charger can include any suitable plug, such as the micro-USB plug that can be plugged into the USB Power-In Port 1704.

The charge manager 1706 is any suitable device that is operable for controlling the charge that is ultimately passed on to the power source 402. A non-limiting example of such a charge manager 1706 is an integrated circuit that allows a maximum of 500 milliamps to be passed therethrough to the power source 402.

The power source 1702 is any suitable battery device that is rechargeable and capable of powering the motors 400. A non-limiting example of a suitable power source 402 is a 3.7 Volt Lithium-Ion rechargeable battery that operates at 3.7V for 500 Milliamp hours (mAh). Thus, in this example, the power source 402 is operable for providing 3.7 volts to the remaining components, as follows.

A receiver (e.g., RF receiver) is used to receive control signals from the remote control device. The receiver is any suitable mechanism or device operable for receiving such control signals, non-limiting examples of which include a blue tooth receiver, and an RF receiver. Thus, in one non-limiting example, the receiver is an RF receiver 1708 that uses, in conjunction with a quartz crystal resonator 1710, an antenna device 1712 to receive control signals from the remote control device. Upon receiving a control signal, the control signal is passed to a motor control unit (MCU) 1714 (e.g., a PCB 410 as illustrated in FIG. 4), which processes the signal in conjunction with a micro-processor 1716. After processing the signal, commands are provided, through a motor driver 1718, to the motors 400.

The MCU 1714 is any suitable mechanism or device (e.g., integrated circuit) capable of governing, in a predetermined manner, the performance of the motor 400. For example, the MCU 1714 might be configured to start and stop the motor, select and regulate the speed, regulate or limit the torque, control the rotational direction of the motor(s) 400, etc. The MCU 1714 can operate as a motor control unit and/or a micro-controller unit that operates to govern the performance of the motor 400.

Further, the micro-processor 1716 is any suitable low power processor (e.g., integrated circuit) that is operable for operating the vibrating pod device, including receiving the control signals, interpreting the control signals, and providing the corresponding commands to the MCU 1714 and/or motor driver 1718 for operation of the vibration motor 1702. It should be noted that the microprocessor 1716 and MCU 1714 can be separately formed or integrally formed as a single module. The motor driver 1718 is any suitable mechanism or device operable for controlling the current and/or voltage (e.g., by providing a constant current) to the motor 400.

As noted above, the motor 400 is selected to provide sufficient torque to tighten the laces. Thus, the motor 400 is any suitable motor that is small enough to be incorporated into the tightening device 100 and provide a suitable torque and rotation. As a non-limiting example, the motor 400 is a miniature motor that is capable of 100 rpm, plus or minus 50 rpm.

Although not required, a visual indicator is desirably used to visually indicate that the tightening device 100 is in an ON or OFF state. As a non-limiting example, the visual indicator can be a light emitting diode (LED) display 1720 that is lit when the tightening device 100 is turned ON and unlit when the tightening device 100 is turned OFF.

As noted above, the tightening device 100 can be optionally controlled via control buttons mounted directly onto the tightening device 100. Alternatively and as illustrated in FIG. 18, a remote control device 1800 can be included to control the features and functions of the tightening device 100. For further understanding. FIG. 18 is a block diagram depicting individual components within the remote control device 1800. As can be appreciated by one skilled in the art, there are many components that can be incorporated into a remote control device to provide the requisite transmission functions, as such, the components described and illustrated are but one non-limiting example as the invention is not intended to be limited thereto. For example, although the remote control device 1800 is illustrated as an RF transmitter, the invention is not limited thereto as any other suitable transmission devices may be employed, non-limiting examples of which include blue tooth, infrared, etc.

Nevertheless, for further understanding, FIG. 18 provides a non-limiting example of suitable remote control device 1800 that is operable for remotely controlling the tightening device. As shown in FIG. 18, the remote control device 1800 includes a power unit 1801 for powering the device 1800. The power unit 1801 is any suitable power device, a non-limiting example of which includes replaceable batteries, such as CR20323 batteries, that provide 3.0 Volts for 180 mAh. The power unit 1801 is used to power the various components of the remote control device 1800, as follows.

As noted above, a plurality of function buttons 1808 can be included on the remote control device 1800 to allow a user to selectively activate the desired function of the tightening device. The function buttons 1808 are communicatively connected (e.g., wired) with a micro-control unit (MCU) 1802 and micro-processor 1804. The MCU 4802 in the remote control device 1800 determines which function button 1808 is depressed and sends the appropriate signal for further processing and transmission to the receiving device (i.e., tightening device).

The micro-processor 1804 generates a control signal based on the appropriate command as received by the function buttons 1808. As a non-limiting example, for example, if a user were to depress an ON function button, an on signal is transmitted to the tightening device to activate the tightening device. Upon releasing the ON function button, the tightening device would cease to tighten.

Once the control signal is generated, it is passed to a transmitter (e.g., RF transmitter 1806), that, in conjunction with a resonator 1808 and antenna 1810, transmits the control signal wirelessly to the tightening device. As was the case above, a visual indicator can be incorporated into the remote control device 1800, a non-limiting example of which includes an LED display 1812 to visually indicate that the remote control device 1800 is being activated.

As can be understood by one skilled in the art, although a specific resonator 1808 and antenna 1810 are illustrated, the present invention is not intended to be limited thereto as any suitable transmitter device with the same or different resonator 1808 and antenna 1810 can be employed.

Finally, it should be understood that the specific examples described and illustrated are provided as non-limiting examples of suitable aspects; however, the invention is not intended to be limited thereto as it can be modified as needed and is to be accorded the widest scope consistent with the principles and novel features disclosed herein.

What is claimed is:

1. A device for automatically tightening a lace, comprising:

a housing;

a first motor attached with the housing;

a power source operably connected with the first motor;

a first spool connected with the first motor such that activation of the first motor causes rotation of the first spool, whereby a user can activate the first motor to cause the first spool to wind the lace around the first spool;

a gear box, the gear box connected with and between the motor and the spool, the gear box adapted to increase torque applied to the spool; and wherein the motor and the gear box are slideably held in the housing, and further comprising a bias mechanism to force the motor and the gear box into an engaging relationship with the spool.

2. The device as set forth in claim 1, further comprising a release mechanism connected with the housing, the release mechanism adapted to allow a user to selectively disengage the spool from the motor, wherein the release mechanism includes at least one release tab that is attached with the motor, the release tab adapted to allow the user to slide the motor and the gear box out of the engaging relationship with the spool and, thereby, disengage the spool and unwind the lace.

3. A device for automatically tightening a lace, comprising:

a housing;

a first motor attached with the housing;

a power source operably connected with the first motor;

a first spool connected with the first motor such that activation of the first motor causes rotation of the first spool, whereby a user can activate the first motor to cause the first spool to wind the lace around the first spool; and a release mechanism connected with the housing, the release mechanism adapted to allow the user to selectively disengage the spool from the motor and, thereby, unwind the lace.

* * * * *